US006186228B1

(12) United States Patent
Wegener et al.

(10) Patent No.: US 6,186,228 B1
(45) Date of Patent: Feb. 13, 2001

(54) METHODS AND APPARATUS FOR ENHANCING WELL PRODUCTION USING SONIC ENERGY

(75) Inventors: Dennis C. Wegener; Daniel R. Maloney; David R. Zornes; Dave E. Reese, all of Bartlesville, OK (US); Michael Lee Fraim, Bakersfield, CA (US)

(73) Assignee: Phillips Petroleum Company, Bartlesville, OK (US)

( * ) Notice: Under 35 U.S.C. 154(b), the term of this patent shall be extended for 0 days.

(21) Appl. No.: 09/201,926

(22) Filed: Dec. 1, 1998

(51) Int. Cl.[7] ..... E21B 28/00; E21B 43/25

(52) U.S. Cl. ..... 166/249; 166/177.2

(58) Field of Search ..... 166/249, 370, 166/177.1, 177.2, 177.6, 177.7

(56) References Cited

U.S. PATENT DOCUMENTS

| | | | | |
|---|---|---|---|---|
| 2,871,943 | | 2/1959 | Bodine, Jr. | 166/249 |
| 3,016,093 | | 1/1962 | Bodine | 166/249 |
| 3,578,081 | | 5/1971 | Bodine | 166/249 |
| 3,823,776 | | 7/1974 | Holmes | 166/261 |
| 3,850,135 | * | 11/1974 | Galle | 116/137 A |
| 3,927,716 | | 12/1975 | Burdyn et al. | 166/270.1 |
| 3,952,800 | | 4/1976 | Bodine | 166/249 |
| 3,990,512 | * | 11/1976 | Kuris | 166/249 |
| 4,019,683 | | 4/1977 | Asai et al. | 239/102.2 |
| 4,037,656 | | 7/1977 | Cooper | 166/270.1 |
| 4,437,518 | | 3/1984 | William | 166/248 |
| 4,485,021 | | 11/1984 | Purcell et al. | 507/244 |
| 4,493,371 | | 1/1985 | Reisberg et al. | 166/271.1 |
| 4,509,599 | | 4/1985 | Chenoweth et al. | 166/370 |
| 4,885,098 | | 12/1989 | Bodine | 210/702 |
| 5,184,678 | | 2/1993 | Pechkov et al. | 166/249 |
| 5,282,508 | | 2/1994 | Ellingsen et al. | 166/249 |
| 5,291,949 | | 3/1994 | Dovan et al. | 166/295 |
| 5,382,371 | | 1/1995 | Stahl et al. | 507/221 |
| 5,418,335 | * | 5/1995 | Winbow | 181/106 |
| 5,538,628 | | 7/1996 | Logan | 210/198.1 |
| 5,547,563 | | 8/1996 | Stowe | 208/106 |
| 5,660,231 | * | 8/1997 | Belonenko | 166/249 |
| 5,727,628 | * | 3/1998 | Patzner | 166/249 |
| 5,829,529 | * | 11/1998 | Cholet et al. | 166/369 |
| 5,836,389 | * | 11/1998 | Wagner et al. | 166/249 |
| 5,950,726 | * | 9/1999 | Roberts | 166/249 |
| 6,012,521 | * | 1/2000 | Zunkel et al. | 166/249 |

OTHER PUBLICATIONS

V.N. Nikolaevskiy et al., Residual Oil Reservoir Recovery With Seismic Vibrations, SPE Production & Facilities, May 1996, pp. 89–94.

S.D. Ball et al., Transient Interfacial Tension Behavior Between Acidic Oils and Alkaline Solutions, *Chem. Eng. Comm.*, vol. 147, pp. 145–156 (1996).

A.M. Sarem, Low Cost Recovery Improvement of High–Wor Waterfloods by MCCF Historical Review, pp. 529–539 (Undated).

J. Wang et al., Study of Enhanced Heavy Oil Recovery by Hot Caustic Flooding, *Heavy Crude and Tar Sands—Hydrocarbons for the 21st Century*, pp. 419–440 (Undated).

(List continued on next page.)

*Primary Examiner*—David Bagnell
*Assistant Examiner*—Jennifer R. Dougherty
(74) *Attorney, Agent, or Firm*—Gary L. Haag

(57) ABSTRACT

The present invention provides methods and apparatus for enhancing the production of liquid hydrocarbons from a subterranean formation penetrated by a well bore. The methods basically comprise placing one or more electric powered sonic energy transducers actuated by magnetostrictive actuators which preferably have drive rods formed of terfenol alloy in the well bore, and causing sonic energy to be emitted from the transducers in the form of pressure waves through the liquid hydrocarbons in the well bore and/or in the formation thereby causing the liquid hydrocarbons to flow into the well bore and to the surface more freely.

23 Claims, 3 Drawing Sheets

OTHER PUBLICATIONS

H.M. Cekirge et al., State–Of–The–Art Modeling Capabilities For Orimulsion Modeling, GFDI, Fl. State Univ., pp. 805–820 Undated).

Caustic Flooding Cost Efficient, *Oilweek*, Sep. 29, 1980, pp. 29–30.

Good Prospects Overcome Domestic Politics, *World Oil*, Aug., 1997, pp. 57–66.

Brochure entitled Etrema Terfenol–D® Magnetostrictive Actuators for Etrema Products, Inc. (Undated).

L. Stavnicky, Design Dimensions—Magnetostrictive Actuators, *Designfax*, Jul., 1994.

M. Goodfriend, Material Breakthrough Spurs Actuator Design, *Machine Design*, vol. 63, No. 6, Mar. 21, 1991, pp. 147–150.

Material "Megamorphs" in Magnetic Field, *Machine Design*, Aug., 1994.

Y.S. Ashchepkov, Infiltration Characteristics of Inhomogeneous Porous Media in a Seismic Field, *Soviet Mining Science*, vol. 25, No. 5, 1990, pp. 492–496.

H.V. Fairbanks et al., Ultrasonic Acceleration of Liquid Flow Through (Undated) Porous Media, *Sonochemical Engineering*, No. 109, vol. 67, pp. 108–116.

N. Akbar et al., Relating P–wave Attenuation to Permeability, *Geophysics*, vol. 58, No. 1, Jan., 1993, pp. 20–29.

K.K. Mohanty et al., Physics of Oil Entrapment in Water–Wet Rock, *SPE Reservoir Engineering*, Feb., 1987, pp. 113–128.

R. Gibson, Jr., Radiation From Seismic Sources in Cased and Cemented Boreholes, *Geophysics*, vol. 59, No. 2, Apr., 1994, pp. 518–533.

I.A. Beresnev et al., Elastic–Wave Stimulation of Oil Production: A Review of Methods and Results, *Geophysics*, vol. 59, No. 6, Jun., 1994, pp. 1000–1017.

Text literature from Chapter 6, Section 6.7 entitled Basic Aspects of Cavitation in Liquids, *Physical Mechanisms for Sonic Processing*, pp. 225–244 (Undated).

* cited by examiner

METHODS AND APPARATUS FOR ENHANCING WELL PRODUCTION USING SONIC ENERGY

BACKGROUND OF THE INVENTION

1. Field of the Invention

The present invention relates to methods and apparatus for enhancing the production of liquid hydrocarbons from subterranean formations penetrated by well bores utilizing one or more sonic energy transducers in the well bores.

2. Description of the Prior Art

The production of liquid hydrocarbons from producing formations and reservoirs is generally assisted to a great extent by naturally occurring forces such as the expanding force of compressed gases, the buoyant and driving force of approaching water and the force of gravity. Primary recovery techniques utilize these forces to cause the liquid hydrocarbons to migrate from subterranean formations into one or more well bores penetrating the formations. Unfortunately, the natural forces are typically only sufficient to allow a small percentage of the total liquid hydrocarbons in formations and reservoirs to be produced.

Secondary recovery techniques are generally employed to recover more of the liquid hydrocarbons in subterranean formations. These techniques utilize extraneous energy forces to supplement the naturally occurring forces in the formations to force the liquid hydrocarbons from the formations into well bores. The extraneous forces can be generated from a large variety of sources including gas injection, steam injection, water injection and the like. These secondary recovery techniques are typically initiated after the primary forces within a formation or reservoir have been at least partially exhausted.

Water flooding is one example of a secondary recovery technique that has been successfully employed in different types of formations. Generally, in accordance with water flooding techniques, one or more injection wells and one or more production wells are utilized. An aqueous solution is injected through the injection wells in order to drive liquid hydrocarbons to the production wells where they are produced. Many modifications to basic water flooding techniques have been developed including the use of certain chemicals and materials in the injection water to help displace the liquid hydrocarbons from the formation. For example, gelling agents are often employed to increase the viscosity of the water and thereby increase its efficiency in driving the oil to the production wells. Surfactants have also been employed to reduce the surface tension of the liquid hydrocarbons and thereby facilitate their production.

Another secondary recovery technique that has been employed to increase the recovery of oil involves the use of low frequency vibration energy. Low frequency vibration from surface or downhole sources has been used to influence liquid hydrocarbon recoveries from subterranean reservoirs. This type of vibration at source-frequencies generally less than about 2000 Hz has been referred to in the literature as sonic, acoustic, seismic, p-wave, or elastic-wave stimulation. For example, stimulation by low frequency vibration has been effectively utilized in some cases in Russia to improve oil production from water flooded reservoirs. Examples from the literature suggest that low frequency stimulation can accelerate or improve ultimate oil recoveries. Explanations for why low frequency stimulation makes a difference vary widely. Examples of such explanations include that the vibration causes the coalescence of oil droplets to reestablish a continuous oil phase, the dislodging of oil droplets so that they can flow as liquid fines, the reduction of capillary forces by altering surface tensions and interfacial tensions and the release of gas which is absorbed at the rock surfaces or dissolved in the water and/or oil phases. For example, U.S. Pat. No. 5,184,678 to Pechkov et al. issued Feb. 9, 1993 discloses a method and apparatus for stimulating fluid production in a producing well utilizing an acoustic energy transducer disposed in the well bore within a producing zone. It is stated in the patent that the acoustic wave radiation transmitted into the producing formation reduces the viscosity of liquid hydrocarbons therein whereby they more readily flow to the well bore.

It is fairly well known that ultrasonic waves can improve and/or accelerate oil production from porous media. The problem with ultrasonic waves is that in general, the depth of penetration or the distance that ultrasonic waves can move into a reservoir from a source is very limited (like less than a few feet), whereas low frequency waves can travel great distances through rock (hundreds to thousands of feet).

While sonic liquid hydrocarbon flow stimulation methods and apparatus have achieved some success in stimulating or enhancing the production of liquid hydrocarbons from subterranean formations, the acoustic energy transducers used have generally lacked sufficient acoustic energy intensity to be significantly effective. Thus, there are continuing needs for improved methods and apparatus which use sonic energy to enhance the production of liquid hydrocarbons such as oil and gas condensate from subterranean formations.

SUMMARY OF THE INVENTION

The present invention provides methods and apparatus for enhancing the production of liquid hydrocarbons from subterranean formations penetrated by well bores which meet the needs described above and overcome the deficiencies of the prior art.

The methods of the present invention are basically comprised of the steps of placing an acoustic energy transducer actuated by at least one electric powered magnetostrictive actuator in a well bore within a liquid hydrocarbon producing formation. Thereafter, acoustic energy in the form of pressure waves is caused to be emitted from the acoustic energy transducer through the liquid hydrocarbons in the formation whereby the surface tension of the liquid hydrocarbons is reduced and the liquid hydrocarbons flow more freely to the well bore.

The electric powered magnetostrictive actuator utilized in the transducer is preferably comprised of a drive rod formed of a terfenol alloy. A coil surrounding the terfenol rod creates an alternating magnetic field in the rod which causes the rod to extend and contract to a greater degree than other types of drive rods. The terfenol drive rod is connected to a flexible element which imparts high intensity acoustic pressure waves to fluids surrounding the well bore for relatively long distances therefrom.

When the liquid hydrocarbons produced are in the form of relatively viscous oil, in addition to the acoustic transducer at least one ultrasonic energy transducer activated by an electric powered magnetostrictive actuator is placed in the well bore and caused to emit ultrasonic wave energy to the liquid hydrocarbons flowing into the well bore whereby the viscosity of the liquid hydrocarbons is temporarily reduced. This reduction in viscosity allows the liquid hydrocarbons to more freely flow through the well bore.

In applications where there is not sufficient pressure drive to cause the liquid hydrocarbons to flow to the surface, an electric powered liquid hydrocarbon pump can be placed in the well bore within the producing formation. The pump can be connected to a string of production tubing disposed in the well bore or to coiled tubing therein. The pump and one or more of the above described sonic energy transducers are connected to a wire line which is in turn connected to a power source and control unit on the surface.

Thus, depending upon the particular application, the type of formation involved and the type of liquid hydrocarbons produced, one or more acoustic energy transducers, one or more of both acoustic energy transducers and ultrasonic energy transducers or one or more of both types of transducers and a liquid hydrocarbon pump are utilized in a well bore penetrating a producing formation.

The apparatus of this invention for enhancing the production of liquid hydrocarbons from a subterranean formation penetrated by a well bore includes a conduit disposed in the well bore for conducting produced liquid hydrocarbons from the subterranean formation to the surface. An electric powered pump is connected to the conduit and positioned in the well bore for pumping the liquid hydrocarbons from the formation through the conduit. one or more electric powered acoustic energy transducers are disposed in the well bore within the formation for increasing the mobility of liquid hydrocarbons therein and allowing the liquid hydrocarbons to flow more freely to the well bore. A power source and control unit is provided on the surface which is connected by a wire line to the pump and the transducers for supplying power and control signals thereto.

The apparatus can also include one or more electric powered ultrasonic energy transducers disposed in the well bore within the formation and connected to the wire line. The ultrasonic energy transducers temporarily reduce the viscosity of liquid hydrocarbons flowing into the well bore whereby the liquid hydrocarbons can be pumped to the surface more easily. The acoustic and ultrasonic energy transducers utilized in the apparatus include magnetostrictive actuators having drive rods formed of a terfenol alloy. The conduit of the apparatus which is disposed in the well bore can be a string of production tubing or it can be coiled tubing.

It is, therefore, a general object of the present invention to provide improved methods and apparatus for enhancing the production of liquid hydrocarbons from subterranean formations or reservoirs.

Other and further objects, features and advantages of the present invention will be readily apparent to those skilled in the art upon a reading of the description of preferred embodiments which follows when taken in conjunction with the accompanying drawings.

DESCRIPTION OF PREFERRED EMBODIMENTS

By the present invention, methods and apparatus for enhancing the production of liquid hydrocarbons from subterranean formations penetrated by one or more well bores are provided. The methods of the invention are basically comprised of the steps of placing one or more acoustic energy transducers actuated by electric powered magnetostrictive actuators, which preferably have drive rods formed of terfenol alloy, in a fluid injection or producing well bore penetrating a liquid hydrocarbon containing formation. The acoustic energy transducers are caused to emit acoustic energy in the form of pressure waves through the liquid hydrocarbons in the formation thereby causing the mobility of the liquid hydrocarbons to be improved and the liquid hydrocarbons to flow more freely to a producing well bore.

The terms "acoustic energy" or "acoustic waves" are used herein to mean vibrations or waves having low frequencies, i.e., less than about 2,000 hertz. The terms "ultrasonic energy" or "ultrasonic waves" are used herein to mean vibrations or waves having very high frequencies, i.e., frequencies above about 10,000 kilohertz. The terms "sonic energy" or "sonic waves" are used herein as general terms which encompass either or both of acoustic and sonic energy or waves.

Figure 5:
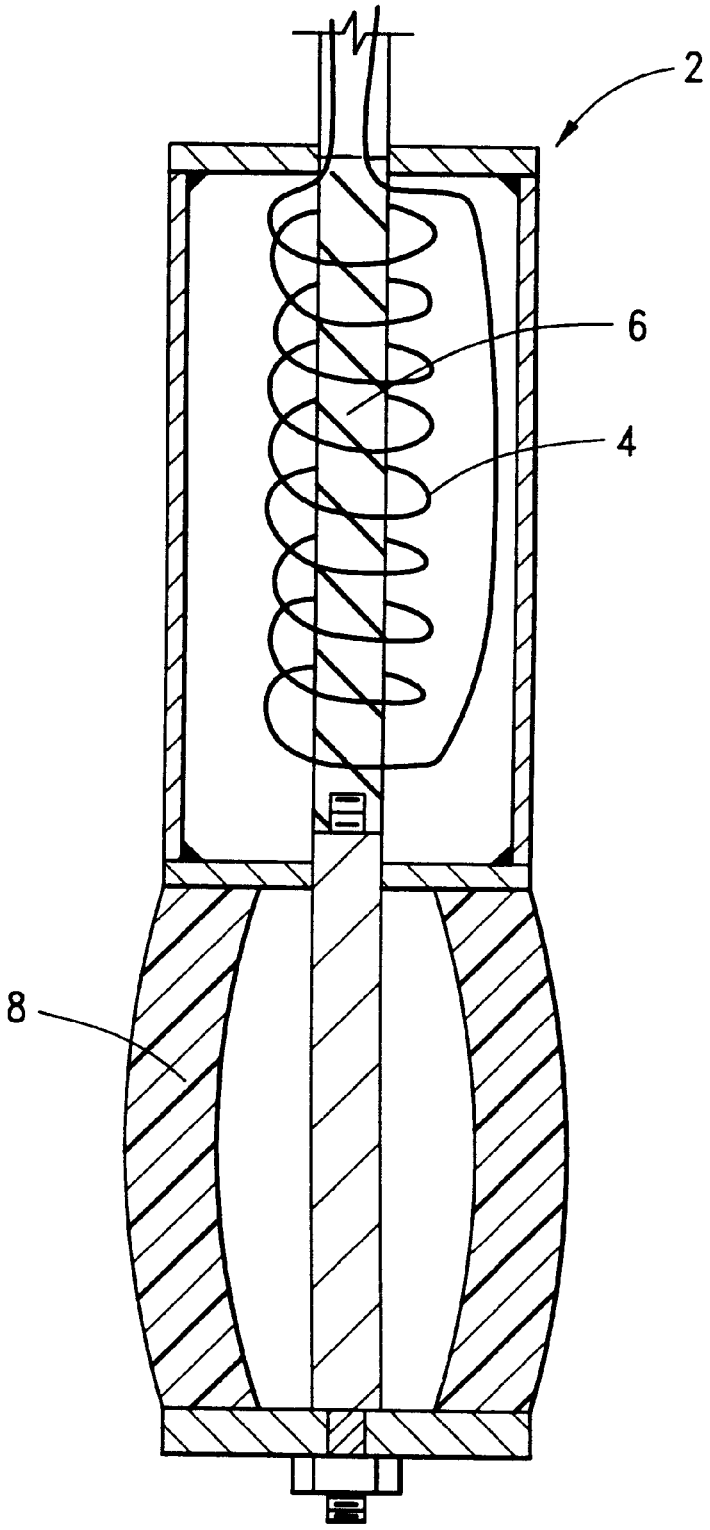
FIG. 5 is a cross-sectional, partially schematic illustration of an energy transducer useful in accordance with this invention.

The terfenol alloy making up the drive rods of the magnetostrictive actuators preferably utilized in accordance with the methods of this invention are composed of the metals terbium, dysprosium and iron. Referring to the energy transducer generally designated by the numeral 2 shown in FIG. 5 of the drawings, a coil 4 surrounding a terfenol rod 6 creates an alternating magnetic field in the rod 6 which causes the rod to extend and contract. The rod 6 is attached to a flexible member 8 that produces sonic pressure waves which are imparted to liquid hydrocarbons in contact with the flexible member 8. The use of transducers having terfenol magnetostrictive actuators like that shown in FIG. 5 to impart sonic energy to liquid hydrocarbons in subterranean formations is very advantageous in that higher wave energy intensity is produced. A transducer actuator drive rod formed of terfenol is a great improvement over prior art drive members such as sucker rods and pizeo crystals. The terfenol drive rods are more durable and do not fatigue as readily as other types of rods. Terfenol is also more energy efficient than other actuator rods, i.e., a greater amount of electricity is converted into sonic waves at higher energy intensity. Also, sonic energy transducers including terfenol drive rods are highly tunable allowing resonate frequency levels to be established which produce desired results. Particularly preferred transducer actuators for use in accordance with this invention include Terfenol-D® drive rods which are commercially available from Etrema Products, Inc. of Ames, Iowa.

An acoustic energy transducer actuated by a magnetostrictive actuator having a drive rod formed of a terfenol alloy produces pressure waves in liquid hydrocarbons having a frequency of from about 10 to about 1,000 hertz and an acoustic energy intensity of from about 0.001 to about 5,000 watts per square meter. The emission of such acoustic waves into liquid hydrocarbons contained in a subterranean formation significantly improves the mobility of the liquid hydrocarbons and allows them to more freely flow to a production well bore.

When the liquid hydrocarbons produced from a particular formation or reservoir have a viscosity above about 100 centipoises, at least one ultrasonic energy transducer is included in a production well bore penetrating the formation or reservoir. The ultrasonic transducer preferably also includes an electric powered magnetostrictive actuator having a drive rod formed of terfenol alloy whereby it emits ultrasonic waves having a frequency of from about 13,000 to about 27,000 kilohertz and an ultrasonic energy of from about 0.1 to about 100 watts per square centimeter. The ultrasonic waves produced are imparted to the viscous oil flowing into the well bore which temporarily reduces the oil viscosity allowing it to more freely flow and to be more easily pumped through a production string or coiled tubing.

Figures 1, 2, 3:
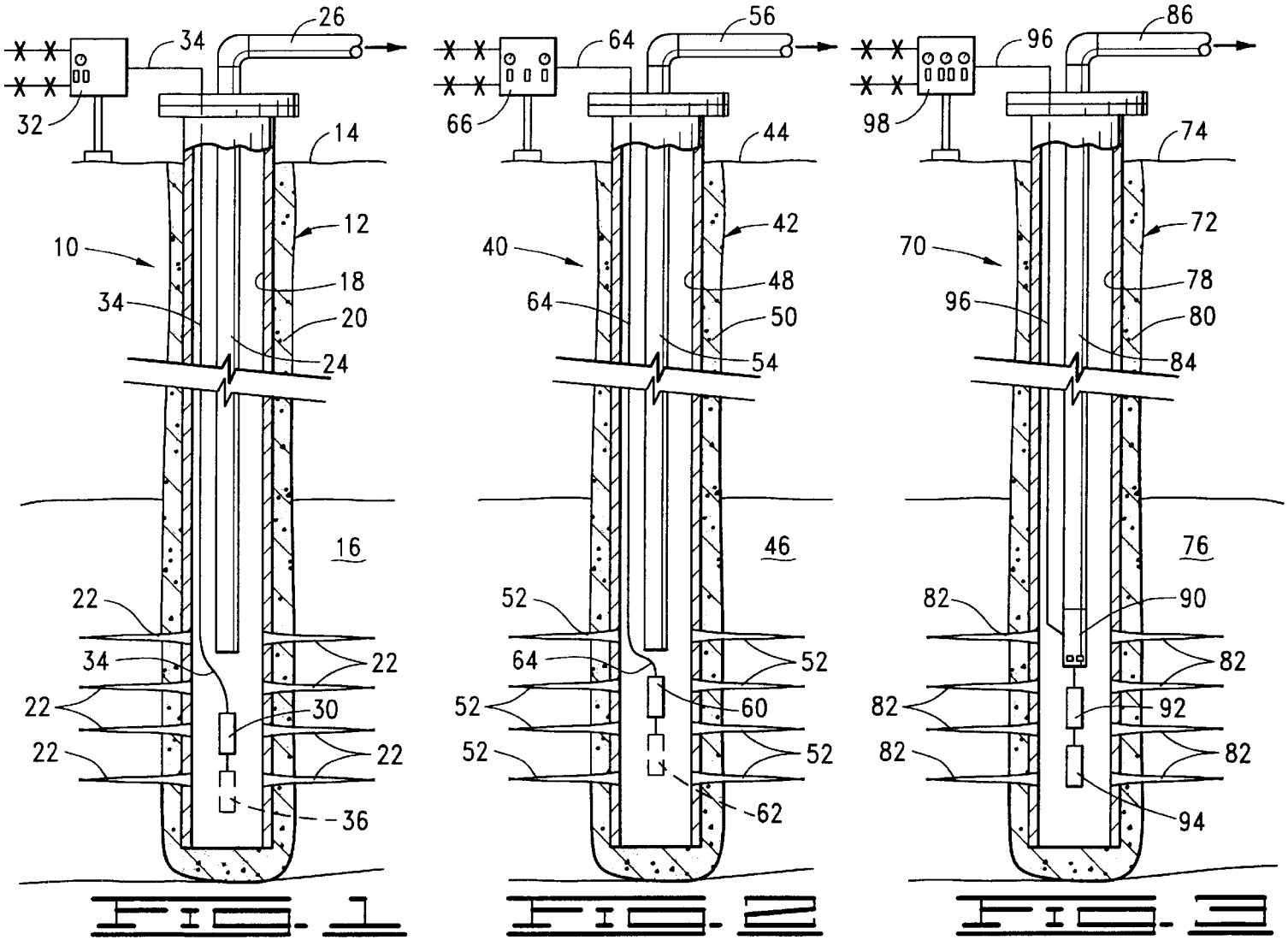
FIG. 1 is a schematic view of a well bore penetrating a natural gas and gas condensate or gas condensate and water producing formation having an acoustic energy transducer disposed therein in accordance with this invention.
FIG. 2 is a schematic illustration of a well bore penetrating a pressure driven oil reservoir having an acoustic energy transducer and an ultrasonic energy transducer disposed therein in accordance with this invention.
FIG. 3 is a schematic illustration of a well bore penetrating an oil producing formation which includes an electric powered pump connected to a string of production tubing disposed therein, an acoustic energy transducer and an ultrasonic energy transducer in accordance with this invention.

Referring now to the drawings and particularly to FIG. 1, a well extending into a subterranean formation containing pressurized gas and liquid hydrocarbons in the form of gas condensate or gas condensate and water is illustrated and generally designated by the numeral 10. The well 10 is comprised of a well bore 12 which extends from the surface 14 into the formation 16. A casing string 18 is sealed within the well bore 12 by cement 20, and a plurality of perforations 22 extend through the casing 18 and cement 20 into the producing formation 16. A production tubing string 24 is disposed within the casing 18 which extends from the surface 14 into the formation 16. The bottom end of the production tubing string 24 is open and the top end is connected to a conduit 26 for conducting pressurized gas and gas condensate or gas condensate and water to a point of storage or further processing (not shown).

As is well known to those skilled in the art, subterranean formations which produce natural gas often produce high quantities of liquid hydrocarbons in the form of gas condensate. However, as the pressure of a gas condensate producing formation is reduced, more and more of the liquid gas condensate becomes immobile and remains in the formation. In order to prevent this loss of the gas condensate, the producing formation has heretofore been pressurized by injecting gas into the formation. Gas injection is a typical means of pressure maintenance for gas condensate reservoirs, and the gas utilized is typically a lean recycled gas, nitrogen or a combination of the two. While gas injection pressure maintenance of the formation prevents the loss of producible gas condensate, it adds considerable costs to the production process.

In accordance with the methods of the present invention, and still referring to FIG. 1, the gas condensate producing formation 16 is not pressurized, and instead, at least one acoustic energy transducer 30 is placed in the well bore 12 within the formation 16. The acoustic energy transducer 30 is actuated by at least one electric powered magnetostrictive actuator having a drive rod formed of terfenol alloy. The transducer 30 is connected to the power and control signal conductors of a wire line 34 which extends from the transducer 30 to a power source and control unit 32 on the surface. The power source and control unit 32 provides electric power for operating the transducer 30 and provides control signals for controlling the frequency and acoustic energy intensity of the pressure waves produced by the transducer 30. The acoustic energy transducer is caused to emit energy in the form of pressure waves that travel into and through gas condensate in the formation 16 which causes it to be mobilized and to flow into the well bore 12 by way of the perforations 22 formed therein.

As the pressure of the formation 16 declines, the pressure of the gas produced which lifts the liquid gas condensate or gas condensate and water through the production tubing 24 to the surface 14 also declines which causes the well bore 12 and production tubing 24 to load up with gas condensate or gas condensate and water whereby the production rate is reduced or terminated. In order to prevent this problem, an electric powered ultrasonic energy transducer 36 (shown in dashed lines in FIG. 1) capable of atomizing accumulations of condensate or condensate and water in the well bore 12 is also placed in the well bore. Ultrasonic atomizers are known to those skilled in the art. For example, such an atomizer is described in U.S. Pat. No. 4,019,683 issued to Asai et al. on Apr. 26, 1977 which is incorporated herein by reference.

When an ultrasonic atomizer is utilized in accordance with the methods of this invention, the transducer preferably includes a magnetostrictive actuator having a drive rod formed of terfenol alloy. After being placed in the well bore 12, the ultrasonic atomizer 36 is caused to emit ultrasonic waves which atomize the accumulations of gas condensate or gas condensate and water in the well bore 12 whereby the atomized liquids are lifted by produced gas through the production tubing.

Thus, the present invention provides a method of enhancing the production of liquid hydrocarbons in the form of gas condensate from a subterranean formation penetrated by a well bore comprising the steps of placing an acoustic energy transducer actuated by at least one electric powered magnetostrictive actuator having a drive rod formed of terfenol alloy in the well bore within the subterranean formation, and then causing acoustic energy in the form of pressure waves to be emitted from the acoustic energy transducer through the gas condensate in the formation whereby the mobility of the gas condensate is improved and the gas condensate flows more freely to the well bore. Further, the present invention provides a method of unloading gas condensate, water or gas condensate and water accumulations in the well bore and production tubing of a gas well comprising the steps of placing an ultrasonic energy transducer capable of atomizing the accumulations and activated by at least one electric powered magnetostrictive actuator in the well bore, and causing ultrasonic energy to be emitted from the ultrasonic energy transducer into the accumulations of gas condensate, water or gas condensate and water whereby the accumulations are atomized and lifted by produced gas through the production tubing.

Referring now to FIG. 2, a well penetrating a pressure driven oil producing formation is illustrated and generally designated by the numeral 40. The well 40 consists of a well bore 42 which extends from the surface 44 to the pressure driven oil producing formation 46. A string of casing 48 is sealed in the well bore 42 by cement 50 and a plurality of perforations 52 extend through the casing 48 and cement 50 into the formation 46. A production tubing string 54 is disposed within the casing 48 which extends from the surface 44 into the formation 46. A conduit 56 is connected to the tubing string 54 for conducting oil produced through the tubing string 54 to a point of storage or further processing (not shown).

At least one electric powered acoustic energy transducer 60 and optionally, at least one electric powered ultrasonic energy transducer 62 which is used to temporarily reduce the viscosity of produced fluids, e.g., oil, are disposed in the well bore 42 within the formation 46. Both of the transducers 60 and 62 are connected to a wire line 64 which extends to the surface 44 and is connected to a power source and control unit 66 on the surface. Both of the transducers 60 and 62 also include magnetostrictive actuators, preferably having drive rods formed of terfenol.

The pressure driven oil bearing formation 46 can include water and the oil can have a relatively high viscosity, both of which impede the flow of the oil through the formation 46. Further, portions of the oil may be emulsified with water or otherwise prevented from flowing through the pore spaces of the formation 46.

The acoustic energy transducer 60 and ultrasonic energy transducer 62 disposed in the well bore 42 within the formation 46 function to emit sonic energy waves into the formation 46 and into the oil and water contained therein so that the mobility of the oil is improved whereby the oil flows more freely to the well bore. Once the oil reaches the well bore, its viscosity is temporarily reduced by the ultrasonic energy emitted by the ultrasonic energy transducer 62 therein which allows the oil to flow to the surface by way of the production tubing 54 more easily. The power source and control unit 66 electrically connected to the transducers 60 and 62 by the wire line 64 provides power to the transducers and control signals are sent thereto to adjust the frequency and energy intensity of the acoustic and ultrasonic waves produced to achieve ultimate results.

Thus, in accordance with a method of the present invention, the production of liquid hydrocarbons from a subterranean formation is enhanced by placing at least one electric powered acoustic energy transducer and at least one electric powered ultrasonic energy transducer in the well bore within the producing formation. Acoustic energy is caused to be emitted from the acoustic energy transducer in the form of pressure waves which pass through the liquid hydrocarbons in the formation so that the mobility of the liquid hydrocarbons is improved and the liquid hydrocarbons flow more freely to the well bore. The ultrasonic energy transducer is caused to emit ultrasonic waves through the liquid hydrocarbons flowing into the well bore whereby the viscosity of the liquid hydrocarbons is temporarily reduced and the liquid hydrocarbons flow more freely through the well bore.

Referring now to FIG. 3, a well 70 is illustrated which penetrates a formation containing water and liquid hydrocarbons, the latter of which is in the form of immobile oil or partially immobile oil. For example, the well 70 may penetrate a formation containing oil below the water-oil contact, i.e., the level below which oil production is zero, or a formation which has been waterflooded and is water saturated whereby oil in the formation is no longer mobile or has become a small fraction of the total production of water and oil, i.e., a high water cut.

The well 70 consists of a well bore 72 which extends from the surface 74 to the oil containing formation 76. A string of casing 78 is cemented in the well bore 72 by cement 80, and a plurality of perforations 82 extend through the casing 78 and cement 80 into the formation 76. A string of production tubing 84 is disposed within the well bore 72 which extends from the surface 74 to within the formation 76. A conduit 86 is connected to the production tubing for conducting oil from the tubing to a point of storage or further processing.

In accordance with the present invention, an electric powered pump 90 is connected to the bottom end of the production tubing 84 for pumping oil from the bottom portion of the well bore 72 to the surface 74. In addition to the pump 90, at least one electric powered acoustic energy transducer 92 and optionally (when the produced oil is viscous), at least one electric powered ultrasonic energy transducer are disposed in the well bore 72 within the formation 76. The pump 90 and transducers 92 and 94 are connected to a wire line 96 which extends to the surface 74. The wire line 96 is connected to a power source and control unit 98 on the surface 74 for providing electric power and control signals by way of the wire line 96 to the pump 90 and transducers 92 and 94. The acoustic energy waves emitted from the acoustic energy transducer 92 improve the mobility of the oil in the formation 72 and allow the oil to flow more freely to the well bore. The ultrasonic energy waves emitted from the ultrasonic energy transducer 94 temporarily lower the viscosity of the oil in the well bore 72 whereby the oil can be pumped to the surface more easily.

Thus, a method of the present invention for enhancing the production of gravity driven liquid hydrocarbons from a subterranean formation penetrated by a well bore is comprised of the steps of placing one or more electric powered acoustic energy transducers, one or more electric powered ultrasonic energy transducers and an electric powered pump in the well bore, the pump being connected to a conduit extending to the surface, and then causing acoustic and ultrasonic energy in the form of pressure waves to be emitted from the acoustic and ultrasonic energy transducers. The acoustic waves improve the mobility of liquid hydrocarbons in the subterranean formation which causes the liquid hydrocarbons to flow more freely to the well bore and the ultrasonic waves temporarily lower the viscosity of the liquid hydrocarbons in the well bore so that the liquid hydrocarbons can be pumped more easily. The low viscosity liquid hydrocarbons are pumped to the surface by the electric powered pump. As mentioned above, the acoustic and ultrasonic energy transducers preferably include magnetostrictive actuators having drive rods formed of terfenol alloy.

Figure 4:
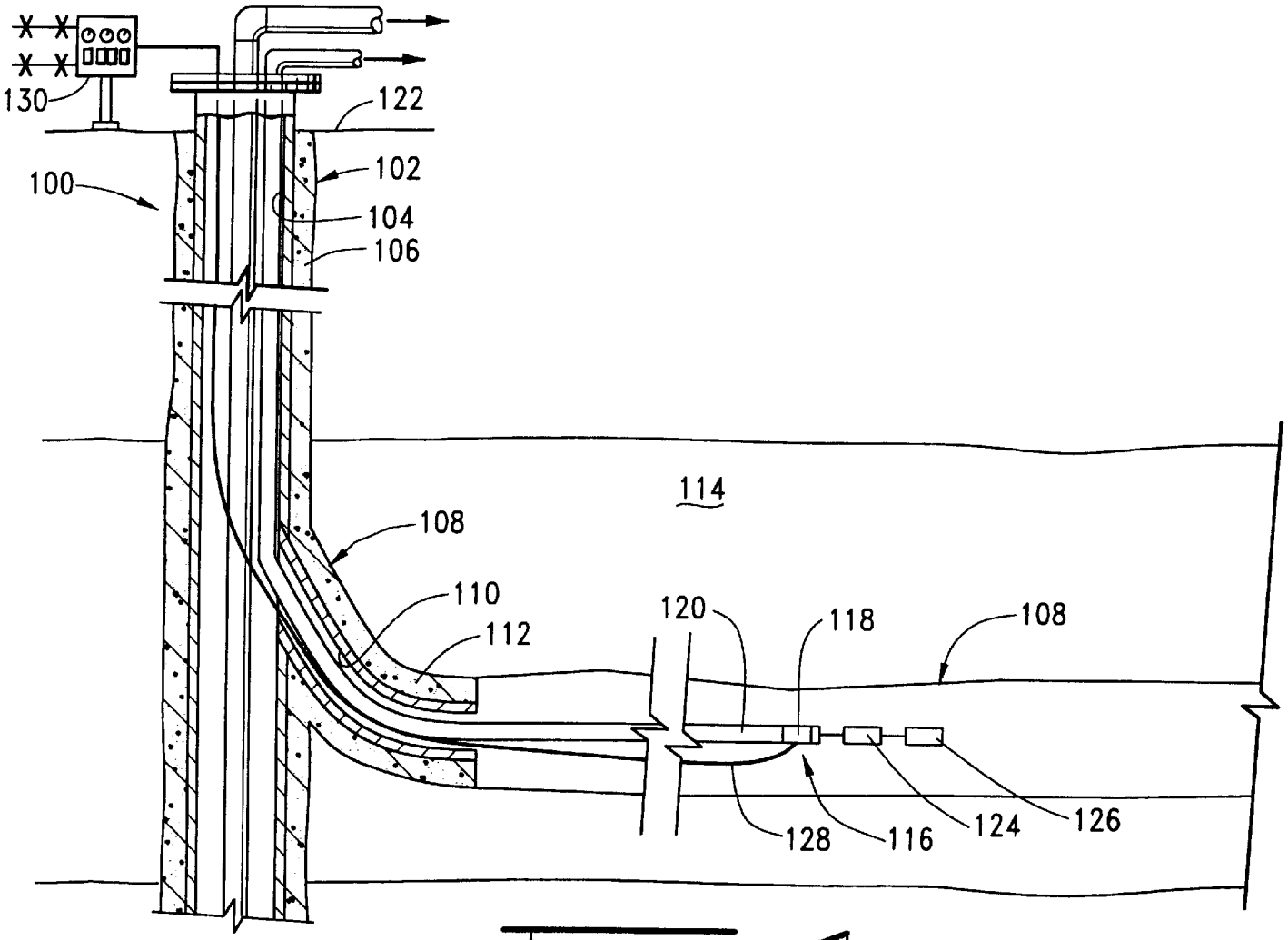
FIG. 4 is a schematic illustration of a well bore which includes a lateral horizontal open hole well bore having coiled tubing, a liquid hydrocarbon pump, an acoustic energy transducer and an ultrasonic energy transducer disposed therein in accordance with this invention.

Referring now to FIG. 4, a well 100 having a lateral horizontal well bore penetrating a liquid hydrocarbon producing formation is illustrated. The well 100 consists of a principal well bore 102 having a string of casing 104 cemented therein by cement 106. A lateral horizontal well bore 108 is joined to the principal well bore 102 by a connecting liner 110. The liner 110 is cemented in a portion of the well bore 108 by cement 112. From the end of the liner 110, an open hole portion of the well bore 108 extends horizontally into the liquid hydrocarbon producing formation 114.

Apparatus of the present invention generally designated by the numeral 116 is disposed in the well bore 108. The apparatus 116 comprises an electric powered pump 118 connected to coiled tubing 120 which extends from the open hole well bore 108 to the surface 122. The coiled tubing 120 conducts liquid hydrocarbons produced therethrough to a point of storage or further processing (not shown). The apparatus 116 further includes at least one electric powered acoustic energy transducer 124 and at least one electric powered ultrasonic energy transducer 126 which along with the pump 118 are connected to a wire line 128. The wire line 128 extends to the surface 122 where it is connected to a power source and control unit 130. As described above, the power source and control unit 130 controls the operation of the pump 118 and the transducers 124 and 126 as well as the frequency and energy intensity of the sonic waves generated by the transducers 124 and 126. Further, the transducers 124 and 126 preferably include magnetostrictive actuators having drive rods formed of terfenol alloy.

The method of using the apparatus 116 in the horizontal well bore 108 is essentially the same as that described in connection with FIG. 3 above. That is, the acoustic energy transducer 124 functions to reduce the surface tension of liquid hydrocarbons in the formation 114 whereby they flow more freely to the well bore 108 and the ultrasonic energy transducer functions to temporarily reduce the viscosity of oil in the well bore 108 whereby it is more easily pumped by the pump 118. In addition, the apparatus 116 can be moved to different locations within the well bore 108 by moving the coiled tubing 120 from the surface.

As will be well understood by those skilled in the art, a variety of conventional downhole tools and parts can be utilized with the apparatus of the present invention to accomplish desired results. For example, centralizers can be used to maintain the transducers, pump and conduit centrally positioned in the well bore.

Thus, the present invention is well adapted to carry out the objects and attain the ends and advantages mentioned as well as those which are inherent therein. While numerous changes may be made by those skilled in the art, such changes are encompassed within the spirit of this invention as defined by the appended claims.

What is claimed is:

1. A method of enhancing the production of liquid hydrocarbons from a subterranean formation penetrated by a well bore comprising the steps of:

placing an acoustic energy transducer actuated by at least one magnetostrictive actuator comprised of a drive rod formed of terfenol alloy in said well bore within said subterranean formation;

causing acoustic energy in the form of pressure waves to be emitted from said acoustic energy transducer through said liquid hydrocarbons in said formation whereby the mobility of said liquid hydrocarbons is improved and said liquid hydrocarbons flow more freely to said well bore or to a separate well bore;

placing an ultrasonic energy transducer activated by at least one magnetostrictive actuator having a drive rod formed of terfenol alloy in a well bore penetrating said formation; and causing ultrasonic energy in the form of waves to be emitted from said ultrasonic energy transducer through said liquid hydrocarbons flowing into said well bore whereby the viscosity of said liquid hydrocarbons is temporarily reduced and said liquid hydrocarbons flow more freely through said well bore.

2. The method of claim 1 wherein said acoustic energy transducer produces pressure waves having a frequency of from about 10 to about 1,000 hertz and an acoustic energy intensity of from about 0.001 to about 5,000 watts per square meter.

3. The method of claim 1 wherein said liquid hydrocarbons are in the form of oil.

4. The method of claim 1 wherein said liquid hydrocarbons are in the form of gas condensate.

5. The method of claim 1 wherein said ultrasonic energy transducer produces waves having a frequency of from about 13,000 to about 27,000 kilohertz and an ultrasonic energy of from about 0.1 to about 100 watts per square centimeter.

6. The method of claim 1 which further comprises the steps of:

placing a liquid hydrocarbon pump in a well bore penetrating said subterranean formation, said pump being connected to a conduit extending to the surface; and pumping said liquid hydrocarbons having temporarily reduced viscosity to the surface.

7. The method of claim 6 wherein said conduit is a tubing string.

8. The method of claim 6 wherein said conduit is coiled tubing.

9. A method of unloading gas condensate or gas condensate and water accumulations in the well bore and production tubing of a gas well comprising the steps of:

placing an ultrasonic energy transducer capable of atomizing said accumulations and activated by at least one magnetostrictive actuator in said well bore; and causing ultrasonic energy to be emitted from said ultrasonic energy transducer into said accumulations of condensate or condensate and water whereby said accumulations are atomized and lifted by gas through said production tubing.

10. The method of claim 9 wherein said magnetostrictive actuator is comprised of a drive rod formed of a terfenol alloy.

11. A method of enhancing the production of oil from a subterranean water saturated reservoir containing immobile oil and water, said reservoir being penetrated by at least one well bore, comprising the steps of:

placing an acoustic energy transducer actuated by at least one magnetostrictive actuator having a drive rod formed of terfenol alloy in said reservoir by way of said well bore;

causing acoustic energy in the form of pressure waves to be emitted from said acoustic energy transducer through said immobile oil in said reservoir whereby said oil is mobilized and flows into a production well bore penetrating said reservoir;

placing an ultrasonic energy transducer activated by at least one magnetostrictive actuator comprised of a drive rod formed of terfenol alloy in said production well bore penetrating said reservoir; and causing ultrasonic energy in the form of waves to be emitted from said ultrasonic energy transducer through said oil produced from said reservoir into said well bore whereby the viscosity of said oil is temporarily reduced and said oil flows more freely through said well bore.

12. The method of claim 11 wherein said acoustic energy transducer produces pressure waves having a frequency of from about 10 to about 1,000 hertz and an acoustic energy intensity of from about 0.001 to about 5,000 watts per square meter.

13. The method of claim 11 wherein said ultrasonic energy transducer produces waves having a frequency of from about 13,000 to about 27,000 kilohertz and an ultrasonic energy of from about 0.1 to about 100 watts per square centimeter.

14. The method of claim 11 which further comprises the steps of:

placing an oil pump in said production well bore penetrating said reservoir, said pump being connected to a conduit extending to the surface; and pumping said oil having temporarily reduced viscosity to the surface by way of said conduit.

15. The method of claim 14 wherein said conduit is a tubing string.

16. The method of claim 14 wherein said conduit is coiled tubing.

17. An apparatus for enhancing the production of liquid hydrocarbons from a subterranean formation penetrated by a well bore extending from the surface to the subterranean formation comprising:

a conduit disposed in said well bore for conducting said liquid hydrocarbons from said formation to the surface;

an electric powered pump connected to said conduit and positioned in said well bore adjacent to said formation for pumping said liquid hydrocarbons therefrom through said conduit;

an electric powered acoustic energy transducer disposed in said well bore adjacent to said formation for reducing the surface tension of liquid hydrocarbons in said formation and allowing said liquid hydrocarbons to flow more freely to said well bore;

an electric powered ultrasonic energy transducer disposed in said well bore adjacent to said formation for temporarily reducing the viscosity of said liquid hydrocarbons flowing into said well bore whereby said liquid hydrocarbons are pumped to the surface more easily;

an electric power source and a control unit on the surface; and a wire line comprised of power and control signal conductors extending from said power source and control unit and connected to said pump, said electric powered acoustic energy transducer and said electric powered ultrasonic energy transducer for supplying power and control signals thereto.

18. The apparatus of claim 17 wherein said acoustic energy transducer and said ultrasonic energy transducer each comprise at least one magnetostrictive actuator.

19. The apparatus of claim 18 wherein each of said actuators comprises a drive rod formed of a terfenol alloy.

20. The apparatus of claim 17 wherein said acoustic energy transducer produces pressure waves having a frequency of from about 10 to about 1,000 hertz and an acoustic energy intensity of from about 0.001 to about 5,000 watts per square meter.

21. The apparatus of claim 14 wherein said ultrasonic energy transducer produces waves having a frequency of from about 13,000 to about 27,000 kilohertz and an ultrasonic energy intensity of from about 0.1 to about 100 watts per square centimeter.

22. The apparatus of claim 17 wherein said conduit is a tubing string disposed in said well bore.

23. The apparatus of claim 17 wherein said conduit is coiled tubing disposed in said well bore.

* * * * *